US008537098B2

(12) United States Patent
Atkins

(10) Patent No.: US 8,537,098 B2
(45) Date of Patent: Sep. 17, 2013

(54) RETENTION AND OTHER MECHANISMS OR PROCESSES FOR DISPLAY CALIBRATION

(75) Inventor: Robin Atkins, Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 225 days.

(21) Appl. No.: 12/848,647

(22) Filed: Aug. 2, 2010

(65) Prior Publication Data

US 2011/0032248 A1 Feb. 10, 2011

Related U.S. Application Data

(60) Provisional application No. 61/231,366, filed on Aug. 5, 2009.

(51) Int. Cl.
*G09G 3/36* (2006.01)

(52) U.S. Cl.
USPC ..... 345/102

(58) Field of Classification Search
USPC ..... 345/214, 102, 87, 204, 211, 212; 359/242, 245, 249; 348/759, 750
See application file for complete search history.

(56) References Cited

U.S. PATENT DOCUMENTS

| | | | | |
|---|---|---|---|---|
| 8,044,949 | B2 * | 10/2011 | Yamazaki | 345/211 |
| 2002/0067326 | A1 * | 6/2002 | Aoki | 345/89 |
| 2007/0222744 | A1 * | 9/2007 | Okita et al. | 345/102 |
| 2008/0252664 | A1 * | 10/2008 | Huang et al. | 345/690 |
| 2009/0128455 | A1 * | 5/2009 | McKay | 345/60 |
| 2010/0238189 | A1 * | 9/2010 | Feng | 345/589 |
| 2011/0025592 | A1 * | 2/2011 | Botzas et al. | 345/102 |

OTHER PUBLICATIONS

"Recommendations for reducing image persistence on large-screen LCDs", May 2005, NEC Display Solutions of America, Itasca, Illinois, www. necdisplay.com.

* cited by examiner

*Primary Examiner* — Abbas Abdulselam
*Assistant Examiner* — Gerald Oliver

(57) ABSTRACT

A "burn-in" is purposely performed on an LCD panel. The "burn-in" is calculated to compensate for an artifact or malfunction of a display using the LCD panel. The "burn-in" may be calculated, for example, to compensate for brightness levels in a light field emanating from the backlight of a dual modulation display. The burn in performed, for example, during periods of "power-off" of the display (e.g., when the backlight of an LCD is off).

19 Claims, 5 Drawing Sheets

400

RETENTION AND OTHER MECHANISMS OR PROCESSES FOR DISPLAY CALIBRATION

CROSS REFERENCE TO RELATED APPLICATIONS

This application claims priority to U.S. Provisional Patent Application No. 61/231,366 filed 5 Aug. 2009, hereby incorporated by reference in its entirety.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of Invention

The present invention relates to calibration of displays.

2. Discussion of Background

Various display devices are known to have one or more different types of "burn-in," a process that generally refers to certain display features that are temporarily or permanently retained in the display. Known processes with respect to "burn-in" are aimed at preventing "burn-in," such as, for example, screen savers which generally apply a changing video or graphic to a display such that no single displayed item has the opportunity to be permanently affixed or associated with the display.

SUMMARY OF THE INVENTION

The present invention provides a number of processes, devices, and techniques that take advantage of retention and/or "burn-in" related properties of a screen, and/or other techniques to either adjust a picture or compensate for artifacts or other anomalies in a displayed image. The present invention may be embodied as, for example, a device comprising a display including a spatial light modulator and a controller configured to energize the spatial light modulator in a manner that causes the spatial light modulator to exhibit retention (also referred to as persistence).

The retention/persistence, or "burn-in," may be calculated, for example, to compensate for an artifact of the display, such as that caused by non-continuity of a backlight of the display. The energization of the display in a manner that causes the persistence of the spatial light modulator is performed, for example, during at least one of "power-off," when no image is displayed, and/or during a blanking interval. In another embodiment, at times when the "persistence image" can be displayed without substantially affecting quality of an image that is being displayed, the persistence image, or portions thereof, may be mixed with the image being displayed.

A controller according to the present invention is configured to energize the display for the desired compensatory persistence, and may be further configured to adjust modulation of one or more spatial light modulators of the display to supplement the compensatory effect of the persistence or to compensate for decay in the persistence image. Compensation for decay occurs, for example, over time during use of the display as the persistence image degrades. Decay in the persistence image may itself be compensated or changed based on the effect of any images displayed. For example, certain images, such as high or low contrast images, displayed on the display may have a greater or lesser affect on the persistence image than other displayed images.

The invention may be embodied as one of several methods embodying any one or more of the steps described herein, including, a method, comprising the steps of energizing an LCD panel to cause a persistence effect, and operating the LCD panel in a manner to produce a desired image while the persistence effect is present. The method may further comprise, for example, the step of determining an image pattern that will cause a persistence effect that compensates for non-smooth qualities of a backlight of the LCD panel, and loading the image pattern into a memory device utilized in energizing the LCD panel for persistence. The method may yet further include energizing the LCD panel to cause a desired image to be displayed, and changing the energization of the LCD panel or an associated backlight over time for a given image to compensate for decay of the persistence image.

The invention may also be embodied as a method comprising the steps of detecting a malfunction in a display, and adjusting an energization level of a modulator (e.g., LCD panel) in order to produce persistence effect configured to compensate for the detected malfunction. The detected malfunction may be, for example, one of a non-operation, change in color, or reduced illumination of a backlight element of the display. Any of the methods, or individual steps, of the present invention may be part of a display comprising a High Dynamic Range (HDR) display including a locally dimmed backlight.

In another embodiment, the invention may be embodied as a display, comprising, a spatial light modulator, a backlight configured to be capable of providing a spatially modulated backlight and positioned to illuminate the spatial light modulator, and a controller configured to provide signals to the backlight causing the spatially modulated backlight to produce an approximation of a desired image and provide signals to the spatial light modulator to further modulate the approximated image in a manner that produces a desired image, wherein the controller is further configured to energize the spatial light modulator in a manner that causes a compensatory persistence to be present in the spatial light modulator. The compensatory persistence allows, for example, a resulting image to have been produced using energization levels associated with a modulated backlight being smoother than that actually provided by the backlight.

The backlight comprises, for example, a set of individually energizable backlight elements and the compensatory persistence compensates for differences in illumination level reaching pixels of the spatial light modulator from similarly energized elements of the backlight. The compensatory persistence, for example, allows energizable elements in the spatial light modulator to be energized at the same level for a same given backlight and desired illumination despite differences in backlight element illumination at the that energization level.

In some embodiments, the invention is implemented in a display comprising an edge lit backlight. The persistence image, for example, accounts for shadows, patterns, and/or other anomalies/artifacts that result from non-uniform mixing of the edge lighting. The edge lit backlight may comprise, for example, any of a constant backlight, a globally dimmed backlight, and a locally dimmed backlight. The dimming controlled light may be projected into at least one of a reflector, diffuser, other modulator, and a cavity behind the spatial light modulator. Dimming controlled backlight embodiments may utilize, for example, a persistence image that is an average of patterns produced from a set of potential backlighting patterns and/or intensities.

Portions of both the device and method may be conveniently implemented in programming on a general purpose computer, or networked computers, and the results may be displayed on an output device connected to any of the general purpose, networked computers, or transmitted to a remote device for output or display. In addition, any components of the present invention represented in a computer program, data sequences, and/or control signals may be embodied as an electronic signal broadcast (or transmitted) at any frequency in any medium including, but not limited to, wireless broadcasts, and transmissions over copper wire(s), fiber optic cable (s), and co-ax cable(s), etc.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

LCD displays have a "feature" which is termed "image persistence". This is similar to burn-in on CRT displays, where an image that has been displayed for a significant period causes a build-up of charge on the individual LCD pixels, resulting in an image "memory".

A concept of the invention is to use image persistence of an LCD display to calibrate the LCD, without requiring any image processing. If a display were to not completely turn-off when not in use, but instead only turn-off the backlight and put up a fixed calibration pattern on the LCD, image retention may be utilized to store the calibration pattern into the LCD. The fixed pattern would be generated during factory calibration, and could include, for example, any of edge rolloff, a repetitive spatial pattern, and color and luminance non-uniformity.

The calibration pattern causes ionic buildup of charge in the LCD which effectively adjusts the value of each pixel, without requiring LCD bits or any processing power for calibration correction. After a time of normal operation, the calibration would fade, but then be "recalibrated" after a long "off" period. Image processing or other compensation may be utilized to supplement the retention calibrations, or to compensate for any fading or decay in the retained or persistence image.

Figure 1:
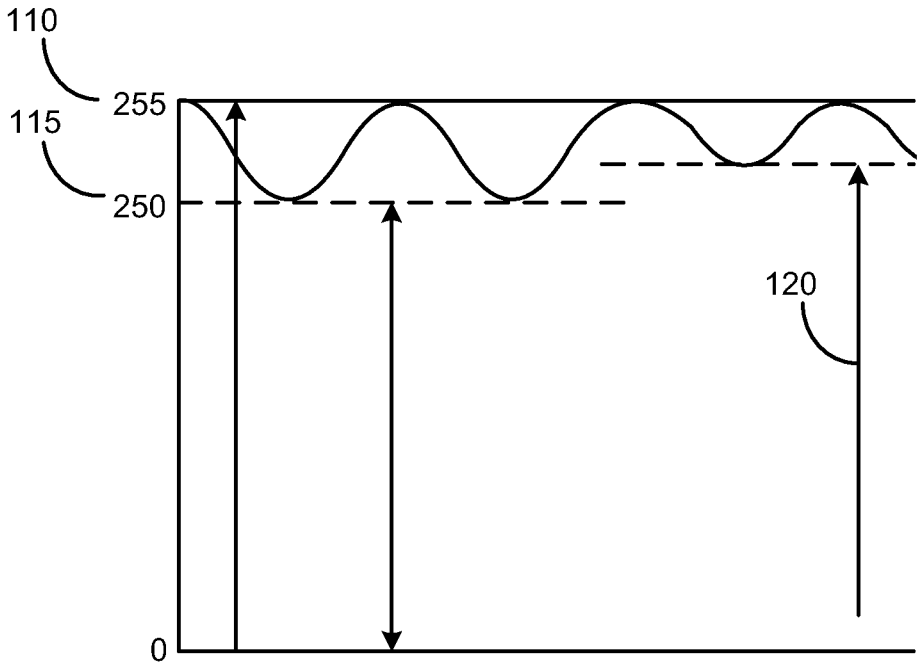
FIG. 1 is a drawing illustrating an issue that is compensated by the present invention.

Referring now to the drawings, wherein like reference numerals designate identical or corresponding parts, and more particularly to FIG. 1 thereof, there a drawing illustrating an issue that is compensated by the present invention. As illustrated, a controller has a set number of adjustments 110 for each LCD pixel or sub-pixel (255 in this example, but any number of adjustments may be available). However, if an unintended variance of illumination levels among the energizable elements of the LCD varies by an amount equivalent to 5 adjustment steps (115), then 5 adjustment steps are generally utilized for compensation of the variance(s). While compensation in this manner is effective, it takes away from the full range of levels available to drive the LCD pixels in a manner most effective for producing the desired image. In various embodiments, the present invention increases the usable range of adjustment levels (120).

Figure 2:
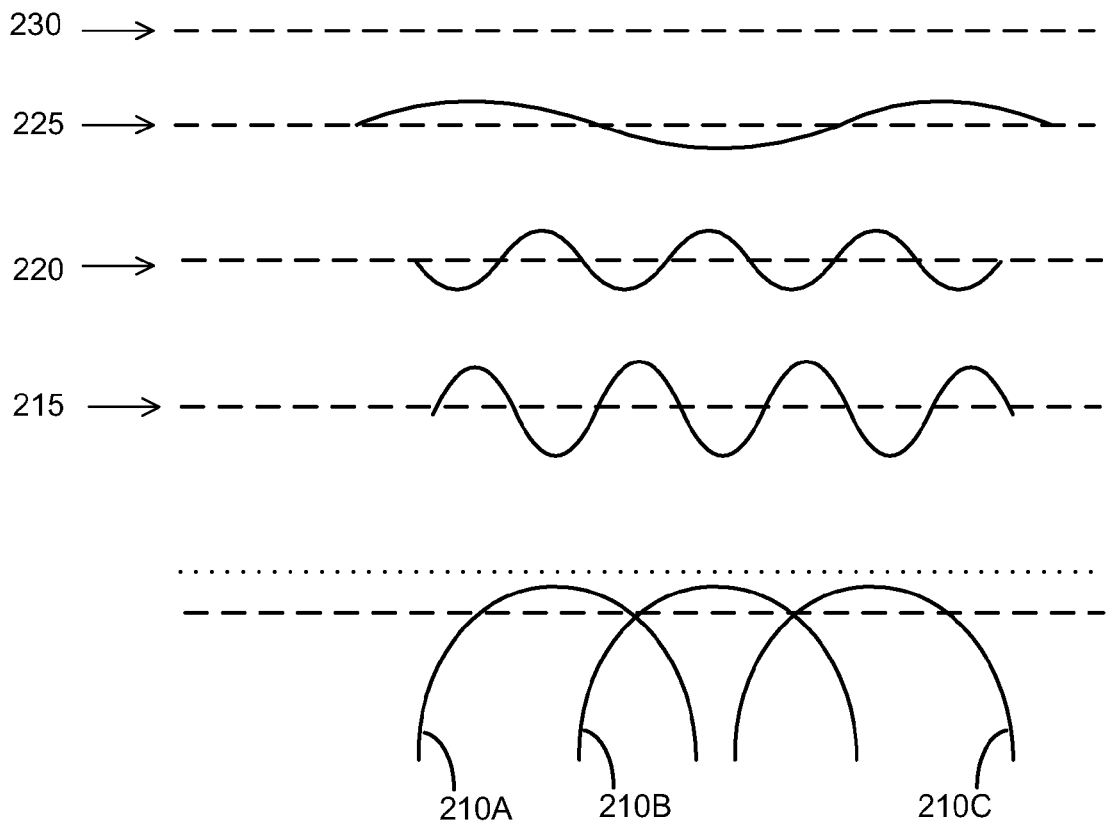
FIG. 2 is an illustration of a desired persistence or "burn-in" according to an embodiment of the present invention.

FIG. 2 is an illustration of use of a desired persistence or "burn-in" according to an embodiment of the present invention. A Light Field (LF) produced by a spatially modulated backlight is provided and illustrated as light levels 210 (210A, 210B, and 210C). As shown, the light field 215 is not entirely uniform as desired (the light field shown is, for example, that of a cluster that should be flat or more smoothly varying). A persistence image 220 has been "burned-into" an LCD panel illuminated by the backlight. The addition of the backlight (as shown by the LF) and the persistence image result in a "light field" 225 at the LCD screen that would occur with an appropriate or more smoothly varying backlight. A full or more full range of available LCD adjustments are then available for generating a desired image 230 and/or further compensation of the backlight or other artifacts.

The LCD panel is then energized with an image (LCD image 230) based on the backlight as modified by the addition of the persistence image. The combination of the modulated backlight, persistence image, and the LCD image create the image displayed for viewing.

Figure 3:
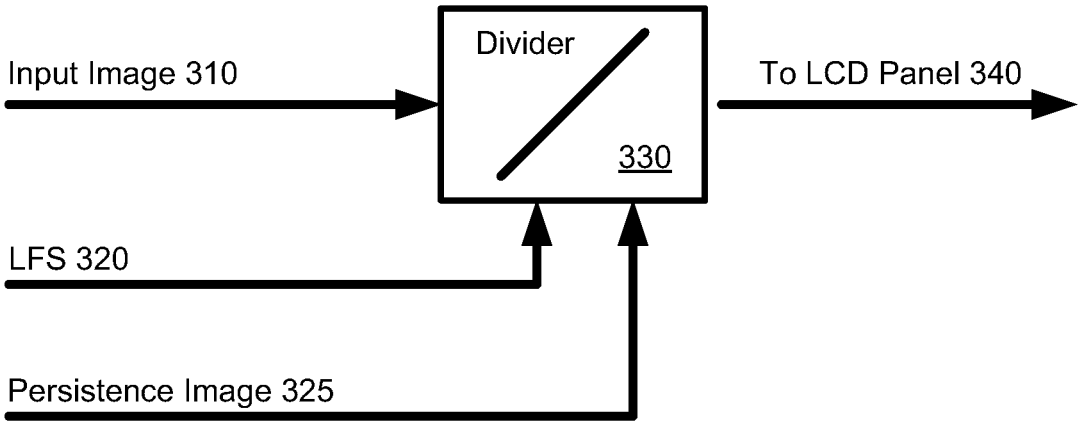
FIG. 3 is a block diagram of a process for energizing a light modulator according to an embodiment of the present invention.

FIG. 3 is a block diagram of a process for energizing a light modulator according to an embodiment of the present invention. A desired image (input image 310) is divided by a simulation of the LF (LFS 320) and a persistence image 325. The persistence image 325 is a set image "burned-into" an LCD panel 340, or is calculated to match the persistence image and an amount of decay in the persistence image. The calculations of the persistence image and division of the desired image are performed, for example, by a controller that energizes the backlight and LCD panel 340 accordingly. Division of the desired image results in a signal to be provided to the LCD panel that comprises an energization level and color of the LCD panel. As energized by the signal (which now accounts for the "burned-in" persistence image), the LCD panel will further modulate the LF (backlight) to produce the desired image.

As described above, the persistence image itself is, for example, calculated to compensate for non-uniformity in, for example, a backlight cluster (e.g., a cluster of LEDs operating as a single backlight element). The persistence image is, for example, "burned-into" an LCD screen. The backlight is, for example, a backlight of a dual modulation display utilizing modulatable LEDs or LED clusters as a backlight.

The persistence image may be used to compensate for anomalies, patterns (e.g., fringing), or other issues present in a light field. Some backlighting arrangements have more issues than others. In one embodiment, the backlight is edge lighting in an edge lit display. The edge lit backlight may, for example, be constant, globally dimmed, or locally dimmed. An inverse pattern of the shadows or other variances in the LF of the edge lit display, as they appear at the LCD panel, may be utilized to produce a persistence image to be "burned-in" to the LCD panel. A persistence image for a constant backlight display and a globally dimmed backlight display may be similar, but may be "darker" for the constant backlight variety. With a locally dimmed implementation, the patterns will vary more widely and may be, for example, an average of all possible patterns, or an average of several more common patterns that occur for a typical motion picture or television program.

Diffuser gradient is also an important and relatively more complicated issue in edge lit displays. In yet another embodiment, the persistence image (in either edge lit or direct backlight displays) is set to account for (alone or in addition to other anomalies) unintended variances in a diffuser of the display. A camera or other test of a gradient diffuser for any particular diffuser sheet may be utilized to determine at least a portion of a persistence image for a display using that particular diffuser.

Further, in some embodiments, an additional modulation layer may be implemented (e.g., dimming controlled backlights illuminating a spatial modulator that illuminates an LCD panel or other final modulator). Any number of additional modulators may be utilized. In all such embodiments, the persistence image is derived to account for variances in the LF caused by any of the light sources, diffusers, polarizers, modulators, diffusers, or other optical elements. In some multi-modulator embodiments, additional persistence images may be implemented (e.g., persistence image 1 "burned-into" an LCD panel, persistence image 2 burned into a pre-LCD panel modulator).

Figure 4:
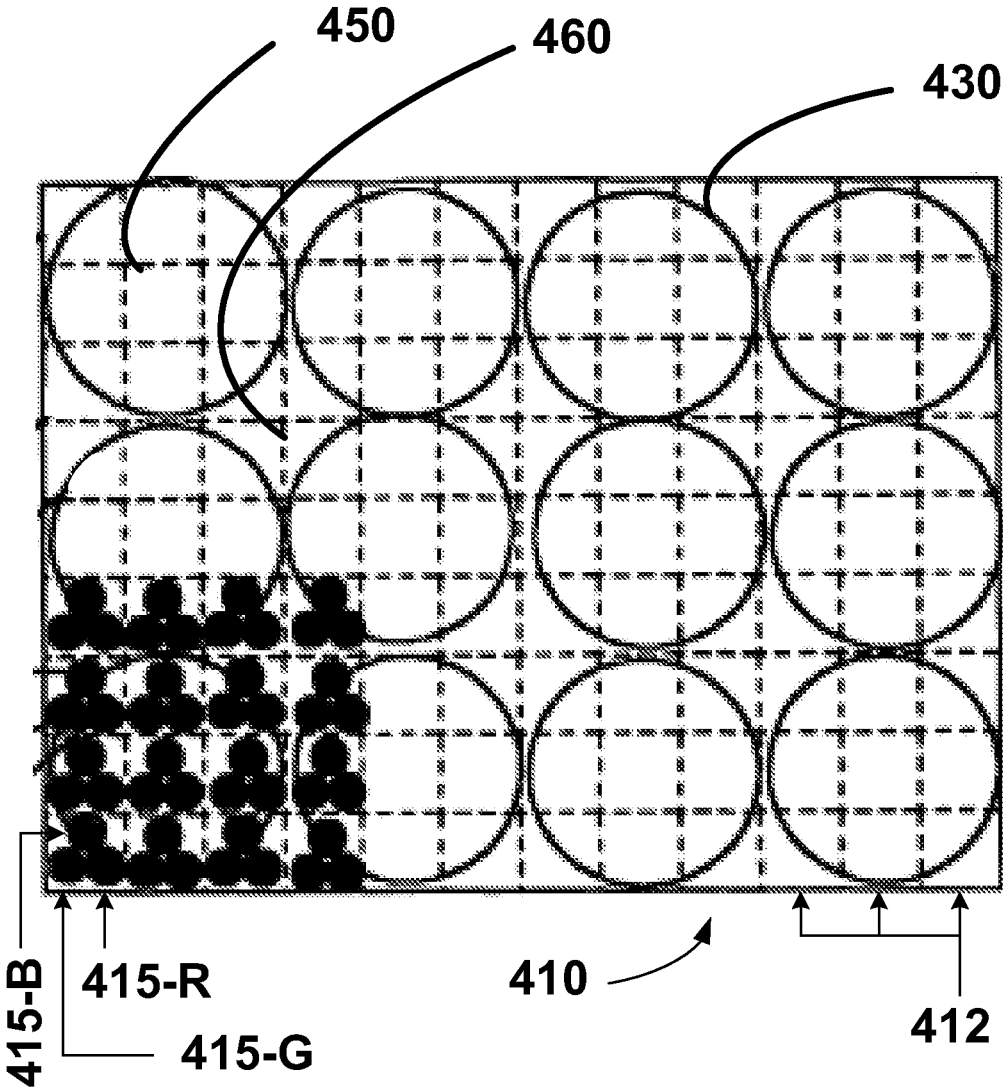
FIG. 4 is a diagram illustrating backlight artifacts and persistence compensation according to an embodiment of the present invention.

FIG. 4 is a diagram illustrating backlight artifacts and persistence compensation according to an embodiment of the present invention. In FIG. 4, a display 400 comprises an LCD panel 410 including individually modulatable pixels (e.g., pixels 412). Each pixel comprises, for example, sub-pixels of red, green, and blue (e.g., 415-R, 415-B, and 415-G respectively). In other embodiments, the LCD panel may have another arrangement, such as, for example, a 2-color sub-pixel panel. In addition, panels with greater than 3 sub-pixels (e.g., 5 sub-pixel systems), and the invention places no restriction or limits, high or low, on the number of sub-pixels or quantity of pixels/sub-pixels necessary for operation.

A backlight of the display 400 comprises, for example, an array of LEDs 430 (not to scale) that are operable to illuminate the LCD panel 410 with, for example, an approximation of a desired image. However a pattern 450-460 of varying light intensities results from less than ideal uniformity of the light sources, or less than optimal mixing/smoothing of a cluster's Point Spread Function (PSF), mixing/smoothing between cluster's, and/or mixing/smoothing between individual LEDs.

Each LCD pixel (or at least one set of LCD pixels) has been "burned-in" with a pattern that compensates for the pattern 450-460, making the full range of available brightness levels available for setting the LCD pixel and/or LEDs/clusters to produce the approximated and/or desired image(s).

Figure 5:
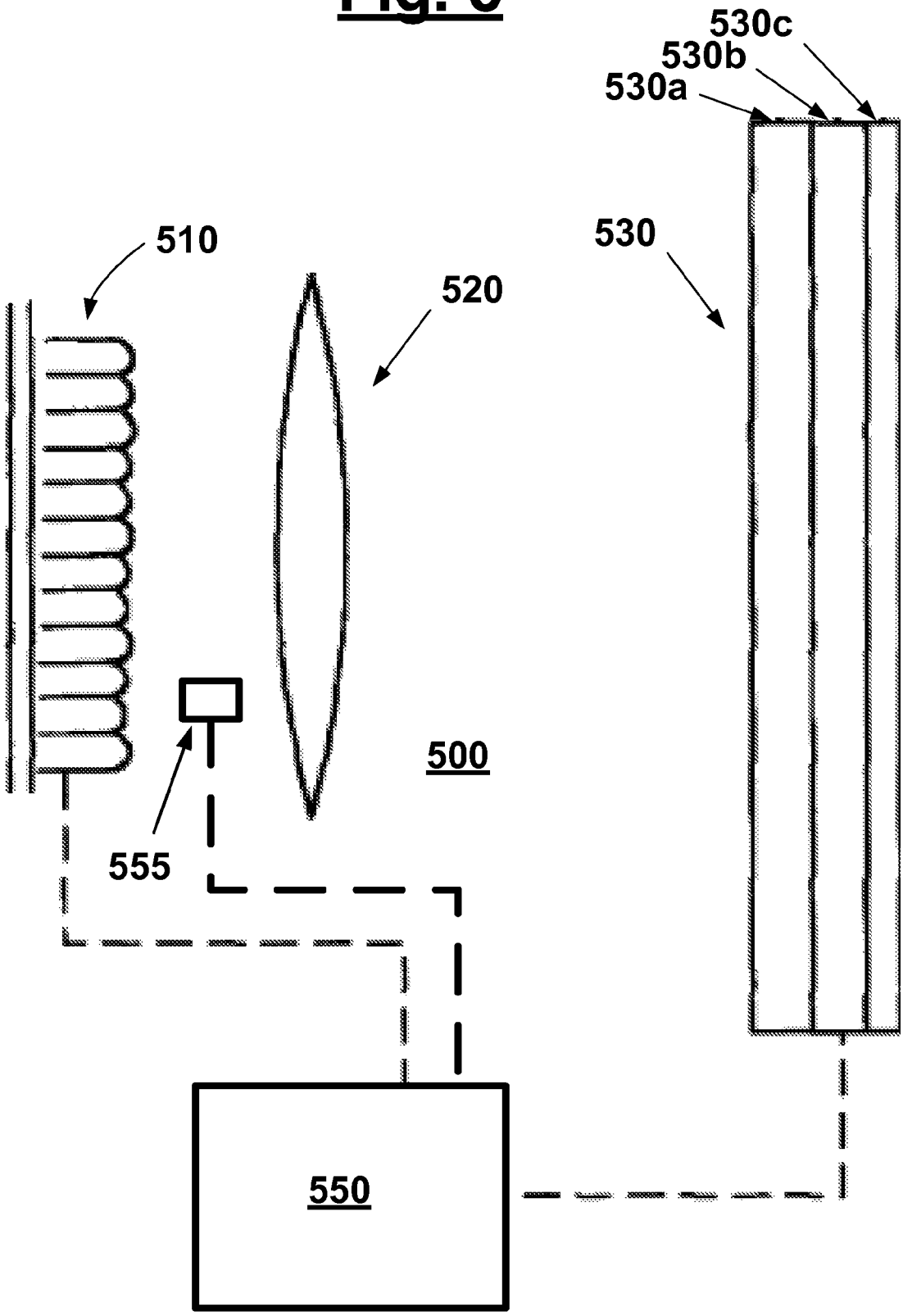
FIG. 5 is a schematic diagram of a display and control system according to an embodiment of the present invention.

FIG. 5 is a schematic diagram of a display and control system 500 according to an embodiment of the present invention. The display and control system comprises the physical elements of a dual modulation HDR display, including a backlight 510 comprising an array of modulatable LEDs. An optical system 520 comprises, any of, for example a lens or array of lenses, an optical cavity, diffusers and the like. An LCD panel system 530 comprises, for example, a collimator 530*a*, LCD panel 530*b*, and a diffuser 530*c*.

A controller 550 is configured to cause the LCD panel 530*b* to burn-in a persistence image that compensates for patterns or non-uniformities of LEDs and/or clusters of the LEDs of the backlight.

In one embodiment, a sensor 555 is configured to detect new anomalies (e.g., a pattern produced by a discolored or malfunctioning LED). The sensor is, for example, mounted in a cavity between the backlight and the LCD panel. In other embodiments, the sensor may be place behind the backlight (or outside the cavity) and rely on a "peep" hole into the cavity. Multiple sensors may be utilized. Upon detection of an anomaly, the controller adjusts the persistence pattern in a manner that compensates for the detected anomaly.

In another embodiment, in a manufacturing setting, a imaging sensor (e.g., camera) (or sensor placed on a scanning device) is utilized to produce a unique persistence pattern for each display. A Point Spread Function (PSF) of individual light sources, or a backlight as a whole, and any variances are accurately measured and then utilized to calculate a persistence pattern for the display. A persistence pattern (or image) so generated may be utilized for other functions as well, including inclusion in a LFS algorithm, LCD image generation/compensation algorithms, and/or utilized as map in detecting backlight malfunctions.

The LCD may be a monochrome panel and the backlight may be multi-colored (e.g., RGB). The persistence pattern may include color compensation. The color compensation, may include, for example, color conversion or correction which may, for example, provide adjustments to compensate for discolored or aging color backlights. A separate persistence pattern may be set up for each color sub-pixel or groups of pixels of the LCD and combined to form a single persistence image. In one embodiment, the LCD image generation is influenced by a combination of a predicted amount of persistence and LCD image compensation.

A decay algorithm or parameters may be based on testing. A weighting between reliance on either a persistence image or other forms of compensation (e.g., backlight energization levels, LCD compensation) may be variable and generally determined by a rate and type of decay for a particular display. The decay itself may also be measured at manufacture, and then memorialized in parameters or table form in memory accessible by the controller and utilized in determining decay compensation for decay and weighting between the various compensation parameters. For less expensive displays, either persistence images and/or decay algorithm parameters may be determined by design or an average across multiple displays—a practice which avoids the manufacturing expense of individual display testing/calibration for either persistence images or decay.

In one embodiment, the set-up of the decay properties comprises a set of segments of the LCD display each segment having specific memorialized decay parameters. The decay parameters may be, for example, determined for each of the color sub-pixels of the LCD panel. In one embodiment, the present invention comprises an algorithm that determines compensation for variances in lighting (e.g., backlighting) using a weighted combination of "burned-in" persistence image(s) and at least one of backlight energization levels, and LCD compensation.

In one embodiment, in a display having a relatively fast decay algorithm, the persistence image is more heavily weighted during warm-up/start-up of a display, and then displaced by shifting the weighting away from the persistence image towards either one or more of backlight energization level compensation, LCD based compensation, and/or another compensation scheme. The shift in weighting or shift in reliance from the persistence image to the other forms of compensation occurs at a rate matching the persistence image rate of decay.

Although the present invention has been described mainly in the form of a dual modulation display and compensating for various artifacts or anomalies associated therewith, it should be understood that the concepts presented here are equally applicable to various forms of display and devices that have any parameter or feature roughly similar to persistence as described herein. Further, in describing preferred embodiments of the present invention illustrated in the drawings, specific terminology is employed for the sake of clarity. However, the present invention is not intended to be limited to the specific terminology so selected, and it is to be understood that each specific element includes all technical equivalents which operate in a similar manner.

For example, when describing an LCD panel, any other equivalent device capable of modulating light and having persistence, whether or not specifically described herein, may be substituted therewith. Furthermore, the inventor recognizes that newly developed technologies not now known may also be substituted for the described parts and still not depart from the scope of the present invention. All other described items, including, but not limited to backlights, LEDs, LED clusters, controllers, panels, power mechanisms, etc should also be considered in light of any and all available equivalents.

Portions of the present invention may be conveniently implemented using a conventional general purpose or a specialized digital computer or microprocessor programmed according to the teachings of the present disclosure, as will be apparent to those skilled in the computer art.

Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art based on the present disclosure.

The present invention includes a computer program product which is a storage medium (media) having instructions stored thereon/in which can be used to control, or cause, a computer to perform any of the processes of the present invention. The storage medium can include, but is not limited to, any type of disk including floppy disks, mini disks (MD's), optical discs, DVD, HD-DVD, Blue-ray, CD-ROMS, CD or DVD RW+/−, micro-drive, and magneto-optical disks, ROMs, RAMs, EPROMs, EEPROMs, DRAMs, VRAMs, flash memory devices (including flash cards, memory sticks), magnetic or optical cards, SIM cards, MEMS, nanosystems (including molecular memory ICs), RAID devices, remote data storage/archive/warehousing, or any type of media or device suitable for storing instructions and/or data.

Stored on any one of the computer readable medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, operating systems, and user applications. Ultimately, such computer readable media further includes software for performing the present invention, as described above.

Included in the programming (software) of the general/specialized computer or microprocessor are software modules for implementing the teachings of the present invention, including, but not limited to, detecting an appropriate power-off or non-viewing condition on a display, energizing a spatial light modulator (e.g., LCD panel) of a display with a desired persistent image, calculating a desired or compensatory persistent image for a display, calculating image energization values for an LCD panel of a display in light of a compensatory persistent image "burned-into" the LCD panel, detecting an artifact or image anomaly, preparing a compensatory persistent image, based, at least in part, on a detected malfunction or anomaly of a display, and the display, storage, or communication of results according to the processes of the present invention.

The present invention may suitably comprise, consist of, or consist essentially of, any element or feature of the invention and/or their equivalents as described herein. Further, the present invention illustratively disclosed herein may be practiced in the absence of any element, whether or not specifically disclosed herein. Obviously, numerous modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. A display comprising:

a spatial light modulator;

a locally dimmed backlight comprising a plurality of clusters of LEDs configured to illuminate the spatial light modulator with an approximation of a desired image; and a controller configured to energize the spatial light modulator when the display is not displaying the desired image in a manner that causes the spatial light modulator to exhibit a persistence calculated to compensate for non-smooth qualities of the locally dimmed backlight caused by non-smooth mixing of point spread functions of LEDs within a cluster causing a non-flat uniformity of a light field from the cluster, the controller further configured to energize the spatial light modulator with image data comprising the desired image divided by a light field simulation of the locally dimmed backlight and the persistence image.

2. The display according to claim 1, wherein the persistence is further calculated to compensate for an artifact of the display.

3. The display according to claim 1, wherein the energization for persistence of the spatial light modulator is performed during at least one of during "power-off," when no image is displayed, and during a blanking interval.

4. The display according to claim 1, wherein the controller is further configured to adjust modulation of the spatial light modulator to compensate for decay in the persistence image.

5. The display according to claim 4, wherein the compensation for decay occurs over time during use of the display.

6. The method according to claim 1, further comprising the step of determining an image pattern that will cause a persistence effect that compensates for non-smooth qualities of a backlight of the LCD panel, and loading the image pattern into a memory device utilized in energizing the LCD panel for persistence.

7. The method according to claim 1, further comprising the steps of: energizing the LCD panel to cause a desired image to be displayed; and changing the energization of the LCD panel over time for a given image to compensate for decay of the persistence image.

8. The method according to claim 1, further comprising the steps of detecting a malfunction in a display comprising the LCD panel, and adjusting the energization level of the LCD panel in order to produce a new persistence effect configured to compensate for the detected malfunction.

9. A method, comprising the steps of: energizing an LCD panel to cause a persistence effect; and operating the LCD panel in a manner to produce a desired image while the persistence effect is present; wherein the persistence effect is calculated to compensate for non-smooth qualities of a locally dimmed backlight caused by non-smooth mixing of point spread functions of light sources within a cluster of light sources causing a non-flat uniformity of a light field from the cluster, the controller further configured to energize the spatial light modulator with image data comprising the desired image divided by a light field simulation of the locally dimmed backlight including the non-flat uniformity and the persistence image.

10. A display, comprising:

a spatial light modulator;

a backlight configured to be capable of providing a spatially modulated backlight and illuminate the spatial light modulator; and a controller configured to provide signals to the backlight causing the spatially modulated backlight to produce an approximation of a desired image and provide signals to the spatial light modulator to further modulate the backlight to produce a desired image;

wherein the controller is further configured to energize the spatial light modulator in a manner that causes a compensatory persistence to be present in the spatial light modulator, the persistence based on non-uniformities in a light field of a cluster of light sources each comprising an individual light source of the spatially modulated backlight.

11. The display according to claim 10, wherein the compensatory persistence causes a resulting image to have qualities associated with a modulated backlight being smoother than provided by the backlight.

12. The display according to claim 10, wherein the backlight comprises a set of individually energizable backlight elements and the compensatory persistence compensates for differences in illumination level between similarly energized elements of the backlight.

13. The display according to claim 10, wherein the compensatory persistence allows each backlight element to be energized at the same level for a same desired illumination despite differences in backlight element illumination at the same energization level.

14. The display according to claim 10, wherein the controller is configured to alter an image being displayed over time to compensate for at least one of decay of the persistent image and a detected malfunction of the display.

15. The display according to claim 10, wherein the detected malfunction is one of a non-operation or reduced illumination of a backlight element of the display.

16. The display according to claim 10, wherein the persistence image includes a color space conversion.

17. The display according to claim 10, wherein energization of the spatial light modulator in the manner that causes the compensatory persistence occurs during times in which the backlight is powered-off.

18. The display according to claim 10, wherein the backlight comprises an edge lit locally dimmed array of light sources.

19. The display according to claim 10, wherein the backlight comprises a plurality of dimming controlled light sources arranged at an edge of the display and configured to project the dimming controlled light into at least one of a reflector, diffuser, other modulator, and a cavity behind the spatial light modulator.

* * * * *